United States Patent [19]

Uesugi et al.

[11] Patent Number: 5,015,153

[45] Date of Patent: May 14, 1991

[54] COMPRESSOR CUTOFF CONTROL RESPONSIVE TO SHAFT POSITION

[75] Inventors: Nichika Uesugi, Fuji; Shingo Ikawa, Fujinomiya; Takayuki Kambe, Mishima, all of Japan

[73] Assignee: Kabushiki Kaisha Toshiba, Kawasaki, Japan

[21] Appl. No.: 379,650

[22] Filed: Jul. 14, 1989

[30] Foreign Application Priority Data

Jul. 26, 1988 [JP] Japan ..... 63-186368
Oct. 25, 1988 [JP] Japan ..... 63-268694

[51] Int. Cl.[5] ..... F04B 49/02
[52] U.S. Cl. ..... 417/44; 318/799
[58] Field of Search ..... 417/53, 1, 44, 18; 318/749, 778, 799

[56] References Cited

U.S. PATENT DOCUMENTS 3,600,657 8/1971 Pfaff et al. ..... 318/244
4,481,786 11/1984 Bashark ..... 62/160

*Primary Examiner*—Leonard E. Smith
*Assistant Examiner*—David W. Scheuermann
*Attorney, Agent, or Firm*—Foley & Lardner, Schwartz, Jeffery, Schwaab, Mack, Blumenthal & Evans

[57] ABSTRACT

The load torque of a compressor for circulating refrigerant in a refrigerating cycle changes with the rotational position of the shaft of the compressor, and the phase difference between the primary current and voltage of an induction motor for driving the compressor changes with the load torque. Taking the above facts into consideration, in turning off the compressor driven by the induction motor, which is powered by a fixed frequency AC power source, the shaft position of the compressor is detected in accordance with the phase difference, and the current of the motor is turned off at the timing of a particular phase difference when the load torque becomes minimum, thus reducing vibration when the compressor is stopped.

11 Claims, 5 Drawing Sheets

FIG 2a
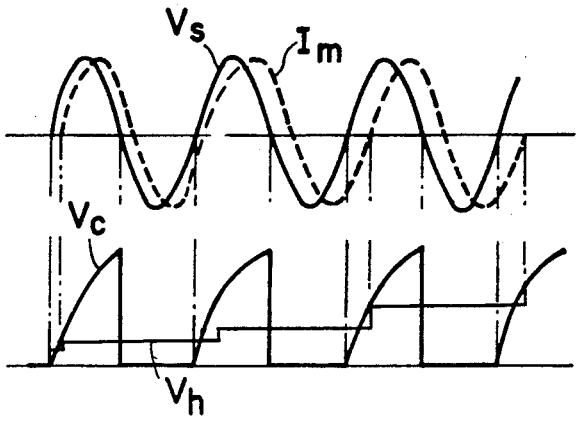
FIG. 2b
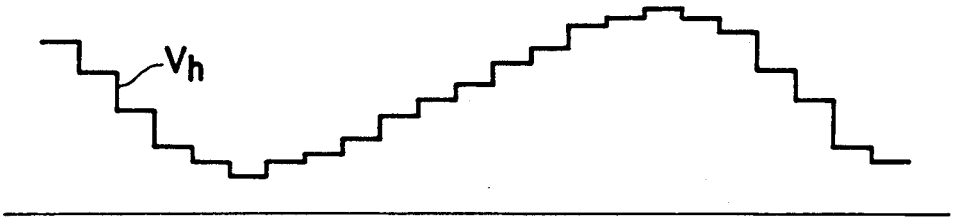
FIG. 3

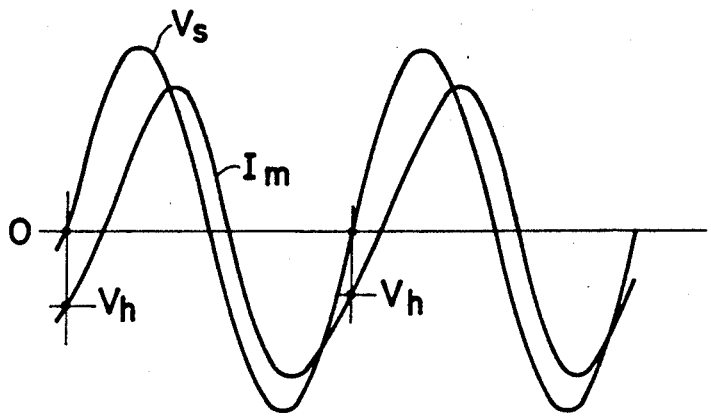
FIG. 6
FIG. 7a
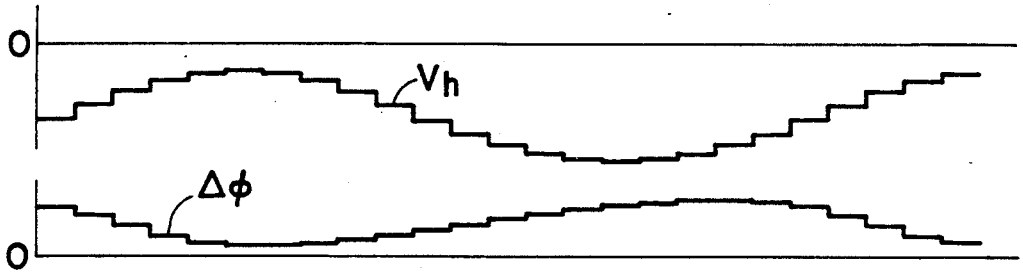
FIG. 7b

COMPRESSOR CUTOFF CONTROL RESPONSIVE TO SHAFT POSITION

FIELD OF THE INVENTION

The present invention relates to a method of and an apparatus for detecting the shaft position of a compressor used for an air conditioner and driven by an induction motor connected to a fixed frequency AC power source, and a control apparatus for stopping an air conditioner by using the shaft position detecting apparatus.

BACKGROUND ART

With an air conditioner having a compressor for circulating refrigerant within a refrigerating cycle, and in which the compressor is coupled to an induction motor driven by a fixed frequency AC power source, the room temperature is controlled by turning on and off the compressor and hence the induction motor while comparing an actual room temperature with a setting temperature and making the difference therebetween zero. In contrast, with air conditioners known as inverter air conditioners, the room temperature is controlled more properly by regulating the air conditioner capability through variable speed running of the compressor, the variable speed running being conducted with the inverter and AC motor.

In both cases, the motors is turned off in order to stop the compressor. In this case, motor for fixed frequency type air conditioners are stopped while the motor is rotating at a relatively high rotational speed corresponding to the fixed frequency, e.g., 50 Hz or 60 Hz, whereas on the other hand the motor for inverter air conditioners are stopped while the motor is rotating at a relatively low rotational speed corresponding to a relatively low frequency.

The load of an air conditioner compressor or driving motor therefor varies greatly during one rotation, between a maximum torque immediately before discharge of the compressor, and a minimum torque at the start of suction of the compressor. Considerable vibration may be generated therefore depending on a shaft position when the compressor is stopped. For instance, in the case of fixed frequency window type air conditioners, upon turning off the motor power, the motor is stopped rapidly from a relatively high rotational speed corresponding to the commercial power source frequency, resulting in large vibrations which are undesirable from the standpoint of maintenance and noise control.

It can be thought that by detecting a shaft position, the motor is controlled to be stopped at a particular shaft position which allows minimum vibration. However, according to the related art, if a Hall effect device is used as a shaft position detecting element, it is difficult in practice to mount such a device on compressors, particularly of the closed type.

SUMMARY OF THE INVENTION

It is therefore a first object of the present invention to provide a simple method of and apparatus for detecting a shaft position of a compressor driven by an induction motor of a fixed frequency power source type.

It is a second object of the present invention to provide a control apparatus for stopping an air conditioner, and which is capable of suppressing vibrations which are generated when a compressor driven by an induction motor of a fixed frequency power source type, is stopped.

In order to achieve the above objects, the present invention proposes a method of detecting the shaft position of a compressor for an air conditioner, characterized in that the shaft position of the compressor is detected on the basis of the phase difference between the current and voltage of an induction motor for driving the compressor connected to a fixed frequency AC power source, and which circulates refrigerant within a refrigerating cycle.

The present invention further proposes an apparatus for detecting the shaft position of a compressor for an air conditioner characterized in comprising a sample/hold circuit for outputting a voltage signal having an amplitude corresponding to a phase difference between the current and voltage of an induction motor for driving the compressor connected to a fixed frequency AC power source, and which circulates refrigerant within a refrigerating cycle, and phase signal outputting means for outputting a phase signal when the voltage signal held by the sample/hold circuit takes a predetermined value.

The present invention still further proposes a control apparatus for stopping an air conditioner characterized in comprising the shaft position detecting apparatus; off-signal outputting means for outputting an off-control signal when a phase difference between current and voltage of an induction motor detected with the shaft position detecting apparatus takes a predetermined value after a compressor-off command has been generated for stopping the compressor; and switching means for turning off an AC power source in response to the off-control signal from the off-signal output means.

The load torque of an induction motor directly coupled to a compressor pulsates greatly during one rotation, between a maximum torque immediately before discharge of the compressor and a minimum torque at the start of suction of the compressor. The torque pulsation does not coincide with a sinusoidal change of the power source because an induction motor used as a driving motor has slip in operation. The phase of the torque pulsation becomes equal to that of the power source at a certain time, and thereafter the shift of the relative phase becomes large until it again becomes zero. Such change is periodically repeated. Assuming that a motor is running with a slip of 5%, the relationship between the power source voltage change and the torque pulsation becomes the same once every 20 cycles of the power source. In the meantime, the phase difference of the primary current and voltage of an induction motor changes in accordance with the amount of instantaneous torque. Namely, the phase difference becomes small for large torque, and large for small torque. By positively utilizing this fact, the instantaneous shaft position of a compressor can be known by detecting the phase difference between input current and voltage of an induction motor.

According to the present invention, the shaft position of a compressor is detected on the basis of the above principle. With this position detecting method, the shaft position can be easily detected on the basis of the current and voltage of a motor and without mounting a specific position detecting device within or near the compressor.

The compressor can be stopped at a specific shaft position by turning off the motor power source at a specific phase difference in accordance with the above-described position detection principle, thus minimizing vibration when the compressor is stopped. Experiments for a window type air conditioner showed that vibration was minimum when the conditioner was stopped at the minimum phase difference.

BRIEF DESCRIPTION OF THE DRAWINGS

In the accompanying drawings,

FIG. 2(*a*) and FIG. 2(*b*) show waveforms used for explaining the relationship between the phase difference between input current and voltage of the motor and an output signal from the sample/hold circuit, respectively shown in FIG. 1;

FIG. 3 shows a waveform of an output signal from the sample/hold circuit with enlarged sampling periods;

FIG. 6 shows current and voltage waveforms of an AC power source; and

FIG. 7 shows a sample/hold signal and a delay time of a current.

DETAILED DESCRIPTION OF THE PREFERRED EMBODIMENTS

Figure 1:
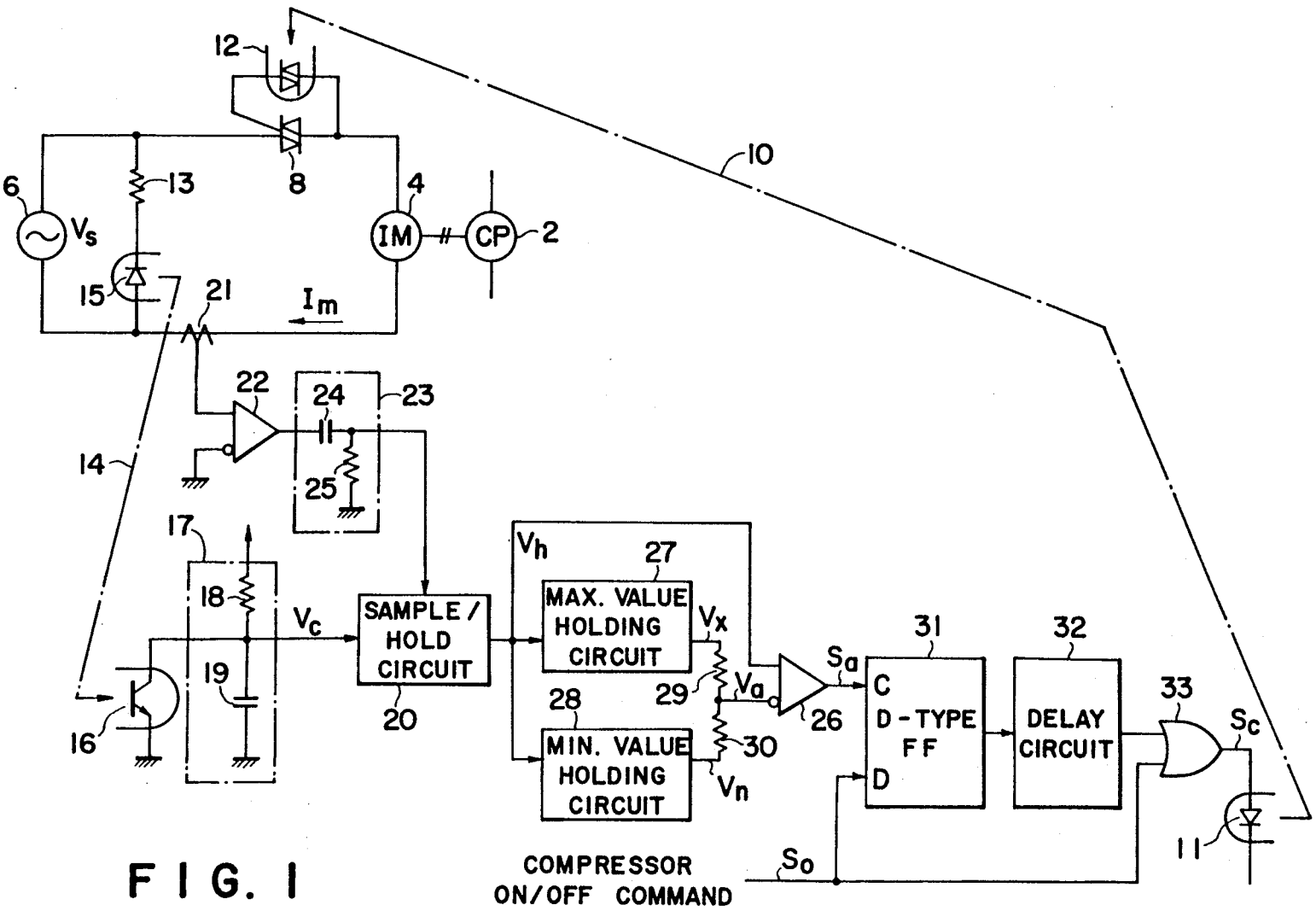
FIG. 1 is a block diagram showing an embodiment of this invention.

FIG. 1 shows an embodiment of the present invention.

In FIG. 1, as the components of a refrigerating cycle for circulating refrigerant of an air conditioner, there is shown only a compressor (CP) 2 which is driven by an induction motor (IM) 4 directly coupled thereto. The induction motor 4 is supplied with a driving power via a TRIAC 8 serving as switching means from a fixed frequency AC power source 6, such as a commercial power source of 50 Hz or an inverter which is operated at a continuously stabilized frequency for at least a certain period. Upon reception of a trigger light from a light emitting diode 11 connected to an output terminal of a control apparatus, the TRIAC 8 is triggered with a bidirectional light receiving element 12. The light emitting and receiving elements 11 and 12 constitute a photocoupler 10. An AC power source 6 is connected via a resistor 13 to a light emitting diode 15 which is illuminated when a negative half cycle voltage of the AC power source 6 is applied. Light emitted from the light emitting diode 15 is received by a phototransistor 16 which is then turned on. The light emitting diode 15 and phototransistor 16 constitute a second photocoupler. The phototransistor 16 is connected in parallel with a capacitor 19 which is charged through a resistor 18. The resistor and capacitor 19 constitute a charge voltage forming circuit 17. The voltage charged in the capacitor 19 is input as a sample voltage to a sample/hold circuit 20.

A current (primary current) of the induction motor 4 is detected with a current detector 21, and a corresponding voltage signal is input to the first input terminal of a comparator 22. The second input terminal thereof has a zero voltage signal input. The output of the comparator 22 is connected to a differential circuit 23 composed of a capacitor 24 and resistor 25. A pulse signal output from the differential circuit 23 is supplied as a sampling control signal to the sample/hold circuit 20.

An output signal $V_h$ obtained from the sample/hold circuit 20 in the above circuit arrangement will be described.

In FIG. 2(*a*), a solid line represents a voltage $V_s$ of the AC power source 6, and a broken line represents a current $I_m$ of the induction motor 4. As shown in FIG. 2(*b*), no current flows through the light emitting diode 15 during a positive half cycle of the voltage of the AC power source 6 so that the light emitting diode 15 does not illuminate. Therefore, the phototransistor 16 is maintained off, and the capacitor 19 is charged through the resistor 18 as indicated by a capacitor voltage $V_c$. At the zero cross point at which a current transits from negative to positive, a pulse signal is output from the differential circuit 23. The pulse signal as a sampling control signal is supplied to the sample/hold circuit 20 which in turn samples the input capacitor voltage $V_c$ and holds it as a sample/hold voltage $V_h$. The sample/hold voltage $V_h$ can be expressed in terms of a function of a phase difference between the voltage $V_c$ and current $I_m$, and is used as a signal representative of the phase difference in this embodiment. As the voltage $V_s$ becomes negative, current flows through the light emitting diode 15 and causes it to illuminate. Upon reception of this light, the phototransistor 16 is turned on to therefore discharge the capacitor 19 and make its charge voltage zero. The above operations are repeated for each cycle of the power source voltage $V_s$.

By repeating the above sampling operation, a sample/hold voltage $V_h$ as shown in FIG. 3 can be obtained, the sample/hold voltage $V_h$ having a cyclical period corresponding to S times of the frequency of the AC power source 6, where S represents a slip of the induction motor 4. For instance, assuming that the slip S of the induction motor 4 is 5%, the sample/hold voltage $V_h$ has a period corresponding to 20 cycles of the AC power source 6 voltage. The value of the sample/hold voltage $V_h$ at a particular phase is used as a pointer for indicating the shaft position of the induction motor 2 and hence compressor 4.

The sample/hold voltage $V_h$ obtained from the sample/hold circuit 20 is input to the first input terminal of a second comparator 26, the maximum value $V_x$ of the sample/hold voltage is held at a maximum value holding circuit 27, and the minimum value $V_n$ is held at a minimum value holding circuit 28. A comparator reference voltage $V_a$ of the comparator 26 which is applied to the second input terminal thereof is obtained by a divider composed of resistors 29 and 30, the comparator reference voltage, being set at a middle value between the maximum value $V_x$ and minimum value $V_n$ and corresponding to the stop position of the compressor. The comparator 26 compares the sample/hold voltage $V_h$ input to the first input terminal with the comparator reference voltage $V_a$ and delivers an output signal $S_a$ as a phase signal. The output signal $S_a$ takes an "H (high level)" signal in the region of $V_h \geqq V_a$ and an "L (low level)" signal in the region of $V_h < V_a$. The output signal $S_a$ m from the comparator 26 is input as a clock signal to the C input terminal of a D-type flip-flop (FF) 31, to the D input terminal of which a compressor on/off command $S_o$ is input. An output signal Q from the D-type flip-flop 31 is input via a delay circuit 32 to an OR gate 33 as its first input signal, the second input signal being the compressor on/off command $S_o$. If $S_o$="H", it means a compressor-on command, and if $S_o$="L", it means a compressor-off command. The delay time of the delay circuit 32 is set at a time $T_D$ longer than a half cycle and shorter than one cycle (of the power source voltage). A compressor-off control signal $S_c$ is output from the OR circuit 33 so that the TRIAC 8 is controlled via the photocoupler 10.

Figure 4:
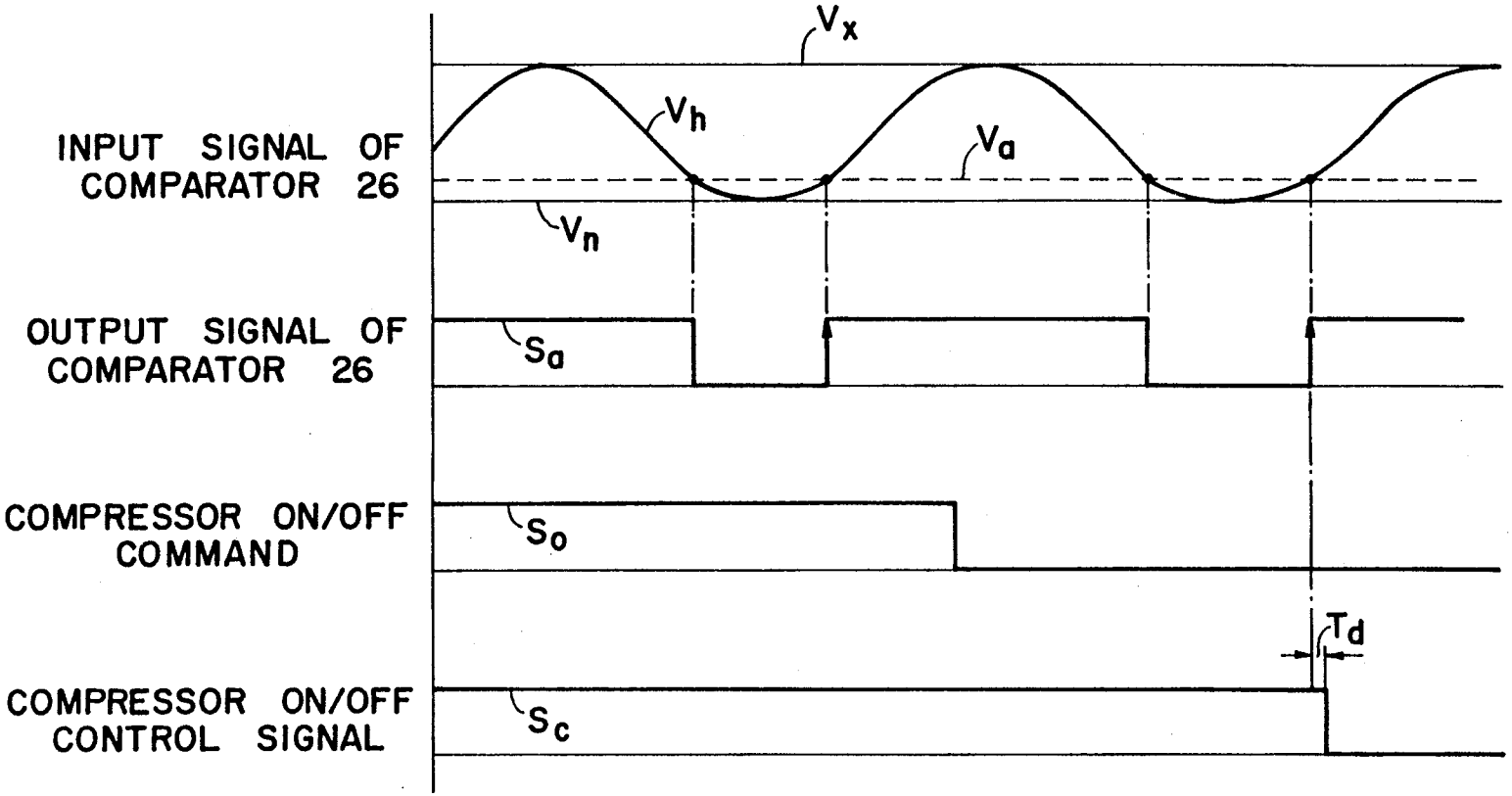
FIG. 4 is a timing chart for explaining the operation of the control apparatus shown in FIG. 1.

The operation of the control apparatus shown in FIG. 1 will be described with reference to FIG. 4.

As described previously, the comparator 26 compares the sample/hold voltage $V_h$ from the sample/hold circuit 20 with the comparator reference voltage $V_a$, and delivers an output signal $S_a$ which takes an "H" signal in the region of $V_h \geqq V_a$ and an "L" signal in the region of $V_h < V_a$. The output Signal $S_a$ is input to the C input terminal of the D-type flip-flop 31. If the compressor on/off command $S_o$ input to the D input terminal is an "H" signal at the rising time when the output signal $S_a$ changes from "L" to "H" (refer to the points indicated by arrow), the induction motor 4 and hence compressor 2 continues to operate. In this condition, even if the compressor on/off command $S_o$ changes to "L", the D-type flip-flop 31 does not change its output. The output of the D-type flip-flop 31 changed to "L" at the rising time when the output signal $S_a$ of the comparator 26 changes from "L" to "H" after the compressor on/-off command $S_o$ became "L". After the lapse of the delay time $T_d$ set at the delay circuit 32 after the rising time, the compressor on/off control signal $S_c$ output from the OR gate 33 becomes "L". Then, the trigger signal to the TRIAC 8 is intercepted so that no current flows after the following current zero cross point. Namely, the current can be stopped at the current zero cross point. The current zero cross point corresponds to the rotary position of the motor 4 and shaft position of the compressor 2 at which vibrations become minimum, thus enabling the compressor 2 to stop with minimum vibration.

It was confirmed from the experiments that when the compressor was stopped at each of eight stages during one cycle of the torque pulsation, the vibration acceleration became minimum at the minimum point of the phase difference. The minimum vibration acceleration was about half the maximum value. According to the present invention, the compressor can always be stopped at the minimum vibration point, thus realizing an air conditioner with substantially small vibration.

In the above embodiment, a TRIAC has been used as a switching element for turning on and off the power source for the induction motor 4. Since the current presently passing through a TRIAC cannot be stopped at once at that time unless a forced quenching means is provided, the above embodiment TRIAC is caused to be turned off at the current zero cross point by providing a delay time equal to or shorter than one cycle. If an element whose turning-on/off can be controlled is used instead of the TRIAC, the current can be stopped immediately at higher precision without providing the delay circuit 32 for waiting for a maximum of one cycle.

In the embodiment shown in FIG. 1, a phase difference between a voltage zero cross point and a current zero cross point of the AC power source is detected to output a signal which turns off the switching means at the current zero cross point. In this case, turning off the switching means is delayed at a maximum of one cycle so that if the slip of the induction motor is not constant, there may be a displacement, although very small, of the shaft position when the compressor is stopped. Such a problem can be solved by the embodiment shown in FIG. 5.

Figure 5:
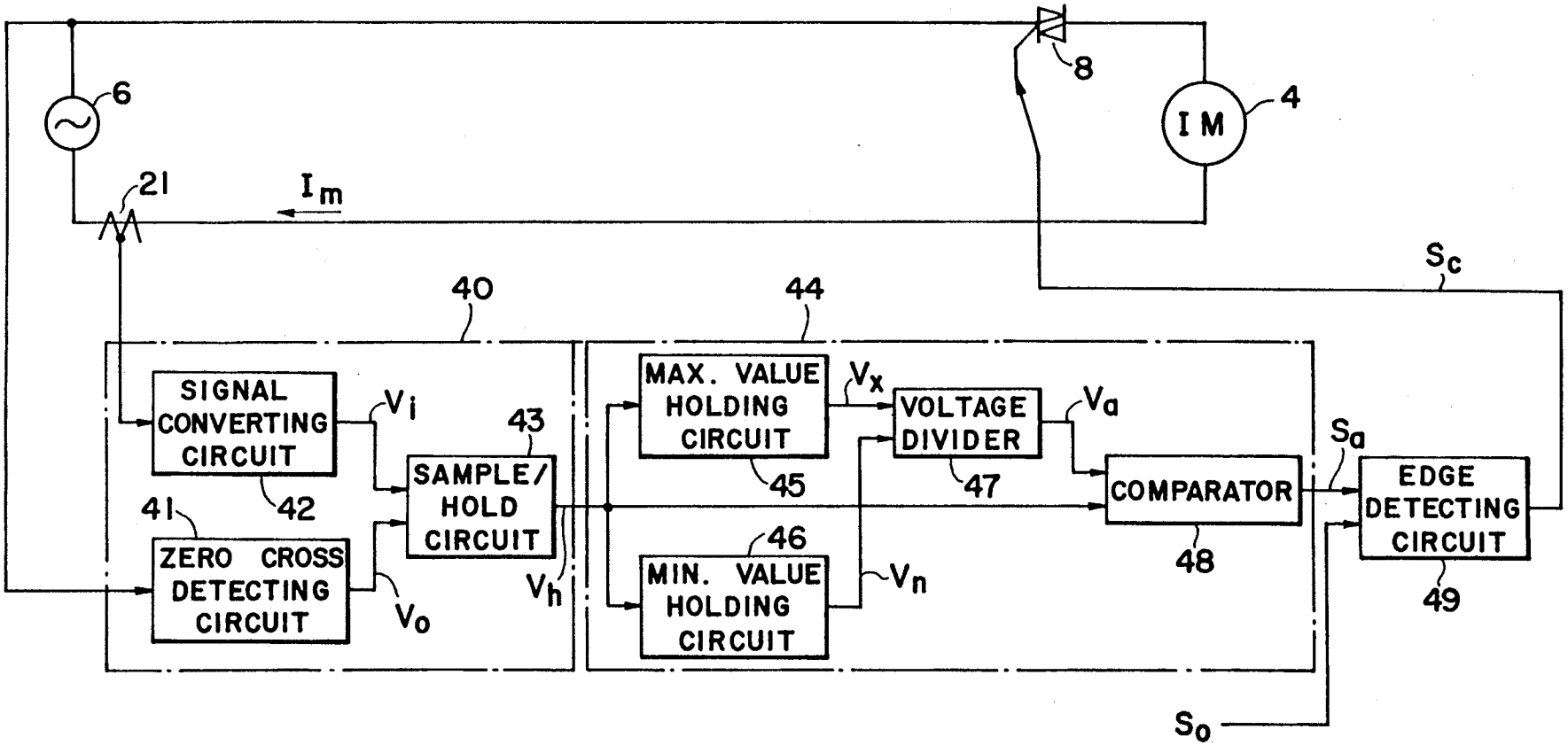
FIG. 5 shows the circuit arrangement of a control apparatus for an air conditioner according to a second embodiment of this invention.

In the embodiment shown in FIG. 5, a power source voltage $V_s$ is applied to a zero cross detecting circuit 41, and an output of a current detector 21 is applied to a signal converting circuit 42. The zero cross detecting circuit 41 detects a zero cross point of the power source voltage $V_s$ and outputs a corresponding zero cross signal $V_o$. The signal converting circuit 42 converts a current $I_m$ into a corresponding voltage signal $V_i$ and outputs it. The voltage signal $V_i$ and zero cross signal $V_o$ are supplied to a sample/hold circuit 43. The sample/hold circuit 43 samples the amplitude of the voltage signal $V_i$ (corresponding to the current value $I_m$) supplied from the signal converting circuit 42 when the AC power source voltage $V_s$ changes from negative to positive, in accordance with the zero cross signal $V_o$, and holds it as a sample/hold signal $V_h$ (refer to FIG. 6). The sample/hold signal $V_h$ changes at each cycle of the power source voltage $V_s$ to thus have a waveform as shown in FIG. 7(*a*). FIG. 7(*b*) shows a phase difference $\Delta\phi$ between the voltage zero cross point at which the current value is sampled and the current zero cross point. A sample generator 40 is constituted by the zero cross detecting circuit 41, signal converting circuit 42 and sample/hold circuit 43.

The sample/hold signal $V_h$ generated at the sample/-hold circuit 43 is supplied to a maximum value holding circuit 45 and a minimum value holding circuit 46, and also supplied to the first input terminal of a comparator 48 to be described later. The maximum and minimum value holding circuits 45 and 46 hold the maximum value $V_x$ and minimum value $V_n$ of the input sample/-hold signal $V_h$, and output them to the corresponding input terminals of a voltage divider 47. The maximum value holding circuit 45 detects the maximum value corresponding to a maximum torque at the time of the voltage zero cross point, and the minimum value holding circuit 46 detects a minimum value corresponding to a minimum torque. The voltage divider 47 is constructed of resistors (refer to FIG. 1) and outputs a comparator reference voltage $V_a$ corresponding to the middle value between the maximum value $V_x$ and minimum value $V_n$. The comparator reference voltage $V_a$ is supplied to the second input terminal of the comparator 48 which compares the sample/hold signal $V_h$ with the comparator reference voltage signal $V_a$ and outputs a position indicating signal $S_a$. The position indicating signal $S_a$ takes an "H" signal when the sample/hold signal $V_h$ is equal to or larger than the comparator reference voltage signal $V_a$ ($V_h \geqq V_a$) and an "L" signal when the former is smaller than the latter ($V_h < V_a$) The position indicating signal $S_a$ is a signal corresponding to a current value detected at the voltage zero cross point. The time when the position indicating signal $S_a$ is obtained corresponds to the time at and from which the current value gradually increases. It can be judged that the load torque of the induction motor 4 is maximum at such a time, and that the shaft position of the compressor is at a maximum torque position immediately before discharge of the compressor. A signal generator 44 is constituted by the maximum value holding circuit 45, minimum value holding circuit 46, divider 47, and comparator 48.

The position indicating signal $S_a$ is supplied to an edge detecting circuit 49 which detects the front or back edge of the rectangular position indicating signal $S_a$ upon reception of a compressor on/off command $S_o$, and outputs at the timing of the front or back edge an off-control signal $S_c$ for turning off the induction motor 4.

A compressor on/off command $S_o$ of "L" is a stop command signal for turning off the compressor and is output upon the actuation of a thermo-switch for detecting a room temperature or upon actuation of a manual switch.

The off-control signal $S_c$ is applied to a TRIAC 8 serially connected to the induction motor 4. The TRIAC 8 and the edge detecting circuit 49 are coupled, for example, by a photocoupler (not shown). When the off-control signal $S_c$ is output from the edge detecting circuit 49 and applied to the TRIAC 8, the TRIAC 8 is turned off so that the induction motor 4 and the compressor connected thereto are stopped.

The power interception by the TRIAC 8 is carried out on the basis of the voltage zero cross point. Namely, the amplitude of the current $I_m$ at the voltage zero cross point of the voltage $V_s$ is detected, and the sample/hold circuit 43 outputs a sample/hold signal $V_h$ corresponding to the amplitude of the current $I_m$. On the basis of sample/hold signal $V_h$, the position indicating signal $S_s$ and off-control signal $S_c$ are generated. Thus, power to the induction motor 4 is intercepted at a certain time during from the voltage zero cross point time to the current phase delay time.

It was confirmed by experiment that when the compressor was stopped at each of eight stages during one cycle of the torque pulsation, the vibration acceleration became minimum at the minimum point of the phase difference. The minimum vibration acceleration was about half the maximum value. It is to be noted that the shaft position for minimum vibration can be obtained for each air conditioner by experiment, and that the divider 47 is adjusted in accordance with the experiment results to determine the comparator reference voltage signal $V_a$.

What is claimed is:

1. A method of detecting the shaft position of a compressor for an air conditioner, comprising the steps of:

detecting a phase difference during each cycle between a primary voltage and a primary current of an induction motor connected to a fixed frequency AC power source which drives a compressor for circulating refrigerant in a refrigerating cycle; and detecting the shaft position of said compressor in accordance with a relationship between a change in said phase difference of said induction motor and pulsation of a load torque relative to the shaft position of said compressor.

2. A shaft position detecting apparatus for detecting the shaft position of a compressor for an air conditioner in which power is supplied via a switch from a fixed frequency AC power source to an induction motor which drives a compressor for circulating refrigerant in a refrigerating cycle, said shaft position detecting apparatus comprising:

sample/hold means for detecting a phase difference during each cycle between a primary voltage and a primary current of said induction motor, and for holding said phase difference as a phase difference signal; and phase signal outputting means for outputting a phase signal representative of the shaft position of said compressor when said phase difference signal held by said sample/hold means reaches a predetermined value.

3. A shaft position detecting apparatus according to claim 2, wherein said sample/hold means outputs a voltage signal having an amplitude corresponding to a phase difference between the phase timing at a zero point of said primary voltage and the phase timing at an immediately following zero point of said primary current.

4. A shaft position detecting apparatus according to claim 2, wherein said phase signal outputting means comprises maximum value holding means for holding a maximum value of said phase difference signal, minimum value holding means for holding a minimum value of said phase difference signal, means for outputting a particular value between said maximum value and minimum value, and comparing means for comparing said phase difference signal with said particular value and outputting a phase signal when said phase difference signal becomes coincident with said particular value.

5. An air conditioner control apparatus for an air conditioner in which power is supplied via a switch from a fixed frequency AC power source to an induction motor which drives a compressor for circulating refrigerant in a refrigerating cycle, said air conditioner control apparatus comprising:

sample/hold means for detecting a phase difference during each cycle between a primary voltage and a primary current of said induction motor, and for holding said phase difference as a phase difference signal;

phase signal outputting means for outputting a phase signal representative of the shaft position of said compressor when said phase difference signal held by said sample/hold means reaches a predetermined value; and off-signal generating means for controlling said switch to turn off said switch in accordance with a compressor-off command for stopping said compressor and said phase signal output from said phase signal outputting means.

6. An air conditioner control apparatus according to claim 5, wherein said sample/hold means outputs a voltage signal having an amplitude corresponding to a phase difference between the phase timing at a zero point of said primary voltage and the phase timing at an immediately following zero point of said primary current.

7. An air conditioner control apparatus according to claim 5, wherein said phase signal outputting means comprises maximum value holding means for holding a maximum value of said phase difference signal, minimum value holding means for holding a minimum value of said phase difference signal, means for outputting a particular value between said maximum value and minimum value, and comparing means for comparing said phase difference signal with said particular value and for outputting said phase signal when said phase difference signal becomes coincident with said particular value.

8. An air conditioner control apparatus according to claim 5, wherein said off-signal generating means comprises a flip-flop for outputting Q-output in response to a phase signal after said compressor-off command, and delay means for forwarding said Q-output from said flip-flop with a predetermined time delay.

9. An air conditioner control apparatus for an air conditioner in which power is supplied via a switch from a fixed frequency AC power source to an induction motor which drives a compressor for circulating refrigerant in a refrigerating cycle, said air conditioner control apparatus comprising:

sample/hold means for sampling a voltage which is indicative of a primary current value of said induction motor during each cycle at a particular phase timing of a primary voltage of said induction motor and for outputting said sampled signal as a sample signal; and control signal generating means for outputting an off-control signal for turning off said switch when said sample signal from said sample/hold means reaches a specific value when an off-command for stopping said compressor has been received.

10. An air conditioner control apparatus according to claim 9, wherein said sample/hold means comprises means for detecting a zero cross point of said primary voltage, and means for sampling said voltage which is indicative of said primary current at a zero cross point of said primary voltage, and for outputting said sample signal.

11. An air conditioner control apparatus according to claim 9, wherein said control signal generating means comprises maximum value holding means for holding a maximum value of said sample signal, minimum value holding means for holding a minimum value of said sample signal, means for outputting a particular value between said maximum value and minimum value, and comparing means for comparing said sample signal with said particular value and outputting said off-control signal when said sample signal becomes coincident with said particular value.

* * * * *